US005527025A

United States Patent [19]

Schlough

[11] Patent Number: 5,527,025

[45] Date of Patent: Jun. 18, 1996

[54] APPARATUS AND METHOD FOR FORMING SHEET MATERIAL ASSEMBLAGES

[75] Inventor: James R. Schlough, Troy, Ohio

[73] Assignee: AM International, Inc., Mt. Clemens, Ill.

[21] Appl. No.: 403,482

[22] Filed: Mar. 14, 1995

[51] Int. Cl.[6] ..... B65H 5/30; B65H 31/20; B65G 17/34

[52] U.S. Cl. ..... 270/58.06; 270/58.25; 271/223; 198/803.11

[58] Field of Search ..... 270/54, 55, 58; 271/170, 223, 294, 295; 198/473.1, 803.11

[56] References Cited

U.S. PATENT DOCUMENTS

| | | | |
|---|---|---|---|
| 1,335,221 | 3/1920 | Christensen . | |
| 2,634,971 | 4/1953 | Schweizer | 270/55 |
| 3,420,518 | 1/1969 | Eveland et al. | 271/223 X |
| 3,825,246 | 7/1974 | Elia et al. | 270/54 |
| 4,124,203 | 11/1978 | Muller | 270/55 |
| 4,681,213 | 7/1987 | Winiasz | 271/206 X |
| 4,721,296 | 1/1988 | Mowry | 270/55 |
| 4,988,086 | 1/1991 | Schlough | 270/55 |
| 5,251,888 | 10/1993 | Eugster | 270/55 |

FOREIGN PATENT DOCUMENTS

| | | | |
|---|---|---|---|
| 55-135049 | 10/1980 | Japan | 271/223 |

*Primary Examiner*—John E. Ryznic
*Attorney, Agent, or Firm*—Tarolli, Sundheim, Covell, Tummino & Szabo

[57] ABSTRACT

An apparatus for forming sheet material assemblages includes a plurality of pockets which are movable past a plurality of sheet material feeders. Each of the pockets includes a sheet material support which is movable between any one of a plurality of closed positions and an open condition. When the sheet material support is in a closed position, it blocks the lower end portion of the pocket and supports sheet material in the pocket. When the sheet material support is in the open condition, it is ineffective to block the lower portion of the pocket so that the sheet material assemblage can move out of the pocket through the lower end portion of the pocket. An actuator is provided to move the sheet material support from the open condition to a closed position. The sheet material support is connected with side portions of the pocket by a four bar linkage. A clutch assembly in the four bar linkage is operable from an engaged condition to a disengaged condition to release the sheet material support for movement from a closed position.

17 Claims, 7 Drawing Sheets

APPARATUS AND METHOD FOR FORMING SHEET MATERIAL ASSEMBLAGES

BACKGROUND OF THE INVENTION

The present invention relates to forming sheet material assemblages in pockets having upper end portions through which sheet material is fed into the pockets and lower end portions through which completed sheet material assemblages leave the pockets.

Newspaper inserting machines may have a construction similar to that disclosed in U.S. Pat. No. 4,721,296 or U.S. Pat. No. 4,988,086. These newspaper inserting machines are used to form sheet material assemblages having a jacket which encloses editorial and/or advertising material. The height of the jacket (the dimension perpendicular to a folded lower edge portion of the jacket) can vary greatly and is frequently dependent on the cylinder size of the printing press used to print the jacket.

When the jackets are fed into a pocket in the newspaper inserting machine, the folded edge registers against the bottom of the pocket. This causes a top edge of the jacket to be at a height which is dependent upon the height of the jacket. Jacket opening components associated with the pocket, such as suckers or grippers, must be adjusted to accommodate the different jacket heights.

SUMMARY OF THE INVENTION

The present invention provides a new and improved apparatus and method for use in forming sheet material assemblages. The apparatus includes pockets which are movable past feeders. The feeders sequentially feed sheet material into the pockets through upper end portions of the pockets.

Sheet material is supported in each of the pockets by a sheet material support. When a complete sheet material assemblage has been formed in a pocket, the sheet material support is moved from a closed position to an open condition. When the sheet material support moves to the open condition, the completed sheet material assemblage can leave the pocket through the lower end portion of the pocket.

In accordance with one of the features of the present invention, the sheet material support is movable to any one of a plurality of different closed positions in which it is spaced different distances from the upper end portion of the pocket to accommodate sheet material assemblages having different heights. The sheet material support is movable from a selected one of the closed positions to an open condition to enable the sheet material assemblage to leave the pocket through the lower end portion of the pocket. An actuator is provided to move the sheet material support from the open condition back to a selected one of the closed positions.

The sheet material support may be connected with side portions of the pocket by a four bar linkage. A clutch assembly may be connected with the four bar linkage. The clutch assembly is operable between an engaged condition and a disengaged condition. When the clutch assembly is in the engaged condition, it holds the links in the four bar linkage against movement relative to each other. When the clutch assembly is in the disengaged condition, the links in the four bar linkage are movable relative to each other to enable the sheet material support to move from the selected one of the plurality of closed positions to an open condition.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF ONE SPECIFIC PREFERRED EMBODIMENT OF THE INVENTION

General Description

Figure 1:
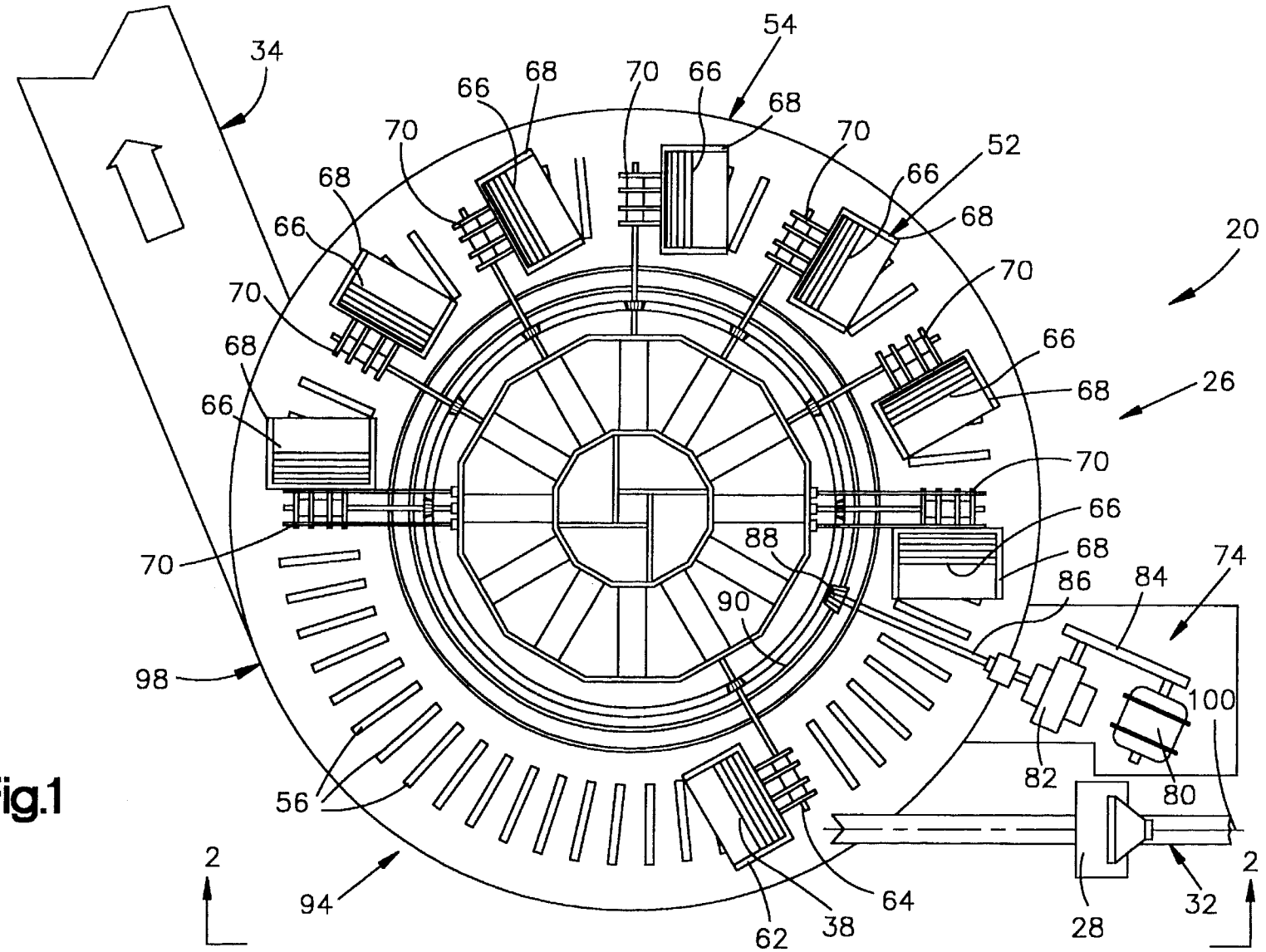
FIG. 1 is a plan view of a sheet material handling apparatus constructed in accordance with the present invention and illustrating the relationship of an array of sheet material feeders to a movable array of pockets.
Figure 2:
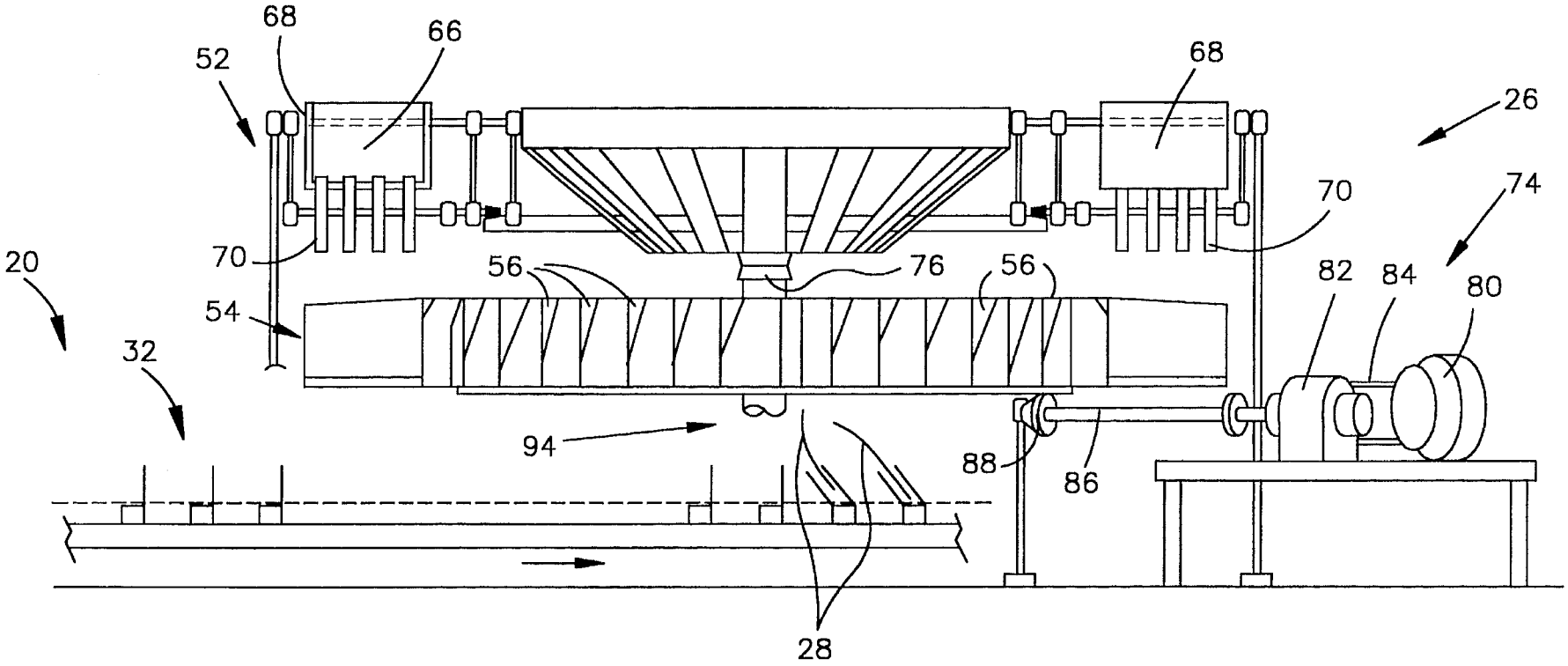
FIG. 2 is an elevational view, taken generally along the line 2—2 of FIG. 1, illustrating the relationship between the sheet material feeders, the movable pockets, and a delivery conveyor.
Figure 3:
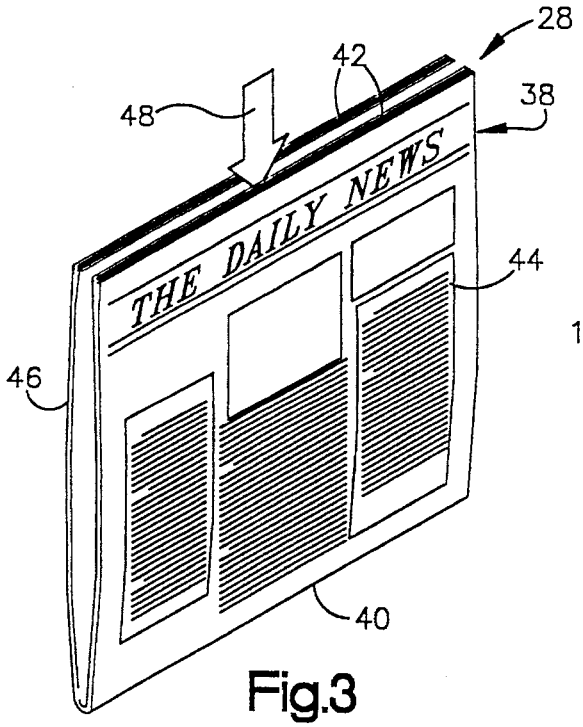
FIG. 3 is a schematic illustration of the manner in which a sheet material assemblage is formed by the sheet material handling apparatus of FIGS. 1 and 2.

A sheet material handling apparatus 20 (FIGS. 1 and 2) forms sheet material assemblages and transports them to a receiving station. The sheet material handling apparatus 20 includes a collating conveyor assembly 26 which is operable to form sheet material assemblages 28 (FIG. 3). A delivery conveyor 32 (FIGS. 1 and 2) sequentially grips sheet material assemblages 28 formed by the collating conveyor assembly 26 and transports them to the receiving station. The delivery conveyor 32 has the construction disclosed in U.S. Pat. No. 4,721,296. Defective sheet material assemblages 28 are conducted to a receiving station by a repair conveyor 34 (FIG. 1).

Although the sheet material of assemblages 28 could take many different forms, for example a collection of individual sheets, a booklet or a group of signatures, the sheet material assemblages 28 are newspapers. Each of the newspapers 28 has a jacket or folded outer cover section 38 (FIG. 3) into which inner sections are stuffed during operation of the collator conveyor assembly 26. The jacket 38 has a folded or closed edge portion 40 and cut or open edge portions 42. A headline side 44 of the jacket 38 extends between the folded edge portion 40 and one of the cut or open edge portions 42. Similarly, a back side 46 extends between the closed edge portion 40 and the other cut or open edge portion 42.

During operation of the collator conveyor assembly 26, the inner sections of the newspapers are inserted into the open jacket 38 in the manner indicated schematically by the arrow 48 in FIG. 3, to form a complete newspaper. It should be understood that sheet material assemblages 28 could be articles other than newspapers. The height of the sheet material assemblages 28 may vary. Thus, the distance from the folded edge portion 40 to the open edge portions 42 for one newspaper may be different than for another newspaper.

Collator Conveyor Assembly

Since the illustrated sheet material assemblages 28 are newspapers, the illustrated collator conveyor assembly 26 is a known newspaper stuffing or assembling machine. It should be understood that the present invention may be used with collator conveyor assemblies having constructions which are different than the construction of the collator conveyor assembly 26. The collator conveyor assembly 26 (FIGS. 1 and 2) includes a stationary sheet material infeed mechanism 52 which is disposed directly above a movable rotor or collating conveyor 54 having a plurality of collating spaces 56. The collating spaces 56 are improved bottom opening pockets constructed and operated in accordance with the present invention.

The sheet material infeed mechanism 52 includes a jacket hopper 62 (FIG. 3) in which a plurality of the jackets 38 are located. The jackets 38 are sequentially fed from the stationary hopper 62 into the pockets 56 of the circular rotor 54 by a sheet feed mechanism 64 with the headline sides 44 of the jackets facing in the direction of movement of the pockets 56. As the rotor 54 moves the circular array of pockets 56 in a counterclockwise direction (as viewed in FIG. 1), inner sections 66 are fed from hoppers 68 by sheet fed mechanisms 70. Of course the number of inner sections fed from the hoppers 68 will vary depending upon the size of a particular newspaper or sheet material assemblage.

A drive mechanism 74 rotates the rotor 54 at a constant speed about a centerpost 76 (FIG. 2) so that the open upper ends of the pockets 56 sequentially move past the stationary circular array of hoppers 62 and 68. The drive assembly 74 includes a motor 80 which is connected with a speed reducer 82 by a belt 84. During operation of the motor 80, a drive shaft 86 rotates a pinion gear 88, disposed in meshing engagement with a ring gear 90 (FIG. 1) fixedly connected with the rotor 54. Rotation of the pinion gear 88 rotates the rotor 54 in counterclockwise direction as viewed in FIG. 1.

As each of the pockets 56 goes through a discharge station 94, the lower end of the pocket is opened. As a pocket 56 opens, a newspaper 28 is dropped from the pocket downwardly to the delivery conveyor 32 (FIGS. 1 and 2). The manner in which the collator conveyor assembly 26 is constructed is generally the same as is disclosed in U.S. Pat. Nos. 2,461,573 and 4,721,296 and will not be further described herein.

Although a specific collator conveyor assembly 26 having a circular construction has been illustrated herein, the collator conveyor assembly could have a different construction. For example, the collator conveyor assembly could have a construction similar to the constructions shown in U.S. Pat. Nos. 4,133,521 or 4,988,086.

If for some unforeseen reason, one of the sheet feed mechanisms 70 should malfunction and fail to feed an inner section 66 into a jacket 38, the pocket 56 containing the defective jacket is not supplied with additional sheet material after the failure to feed by one of the sheet material feed mechanisms 70 is detected. The pocket 56 is moved to the discharge station 98. At the discharge station 98, the lower end of the pocket 56 is opened. As the lower end of the pocket 56 opens, a defective newspaper 28 is dropped from the pocket downwardly onto the belt-type repair conveyor 34. The discharge station 98 is located ahead of the discharge station 94 so that the pockets 56 are moved through the discharge station 98 before they move through the discharge station 94.

In accordance with a feature of the present invention, the pockets 56 are constructed to enable them to support jackets 38 (FIG. 3) having different heights with the upper ends of the jackets in the same position relative to the pockets. Thus, in FIG. 4, the relationship between a relatively short newspaper jacket 38*a* and a pocket 56 is illustrated. In FIG. 5, the relationship between a relatively tall newspaper jacket 38*b* and the pocket 56 is illustrated.

In accordance with one of the features of the present invention, the pocket 56 has a sheet material support 108 which is movable through a range of closed positions relative to a fixed sidewall 102 and a movable sidewall 104 of the pocket 56. This enables open upper edge portions 42 of the short newspaper jacket 38*a* (FIG. 4) to be disposed in the same relationship with the fixed sidewall 102 and a movable sidewall 104 of the pocket 56 as are the open upper edge portions 42 of a tall newspaper jacket 38*b* (FIG. 5). Therefore, grippers or suckers (not shown) associated with the fixed sidewall 102 and/or the movable sidewall 104 of the pocket 56 can engage the open upper edge portions 42 of either the short newspaper jacket 38*a* or the tall newspaper jacket 38*b*.

Figure 4:
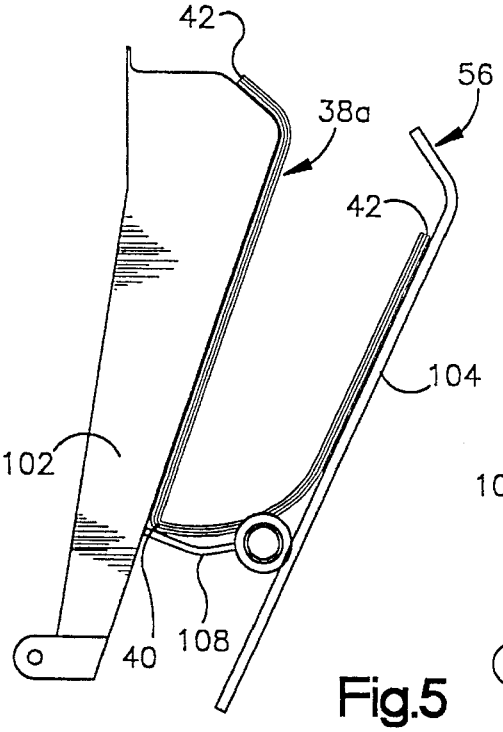
FIG. 4 is a simplified schematic illustration of one of the pockets, a sheet material support in the pocket being shown in an uppermost closed position.
Figure 5:
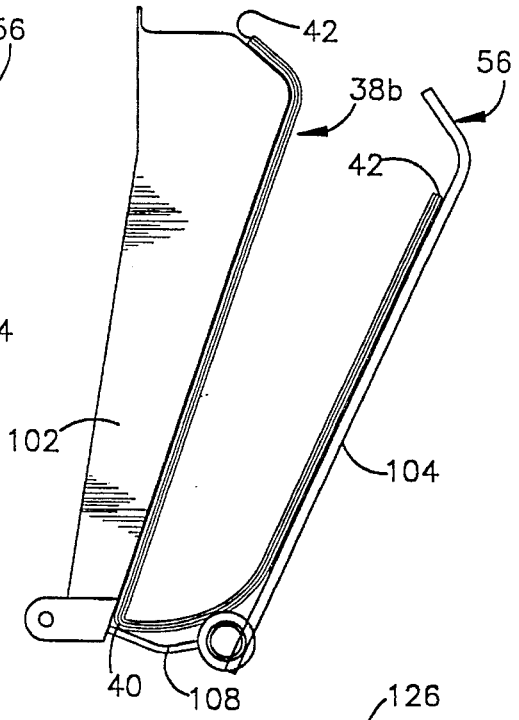
FIG. 5 is a simplified schematic illustration, generally similar to FIG. 4, of the pocket with the sheet material support in a lowermost closed position.

When a short newspaper jacket 38*a* is to be held in the pocket 56, the sheet material support 108 is relatively close to the open upper end portion of the pocket 56 (FIG. 4). When a tall newspaper jacket 38*b* is to be held in the pocket 56, the sheet material support 108 is relatively far from the open upper end portion of the pocket 56 (FIG. 5). By adjusting the closed position of the sheet material support 108 to correspond to the height of the newspaper jacket 38, the open upper edge portion 42 of either a short newspaper jacket (FIG. 4) or a tall newspaper jacket (FIG. 5) will be in the same location relative to the sidewalls 102 and 104 of the pocket 56.

Linkage Assembly

Figure 6:
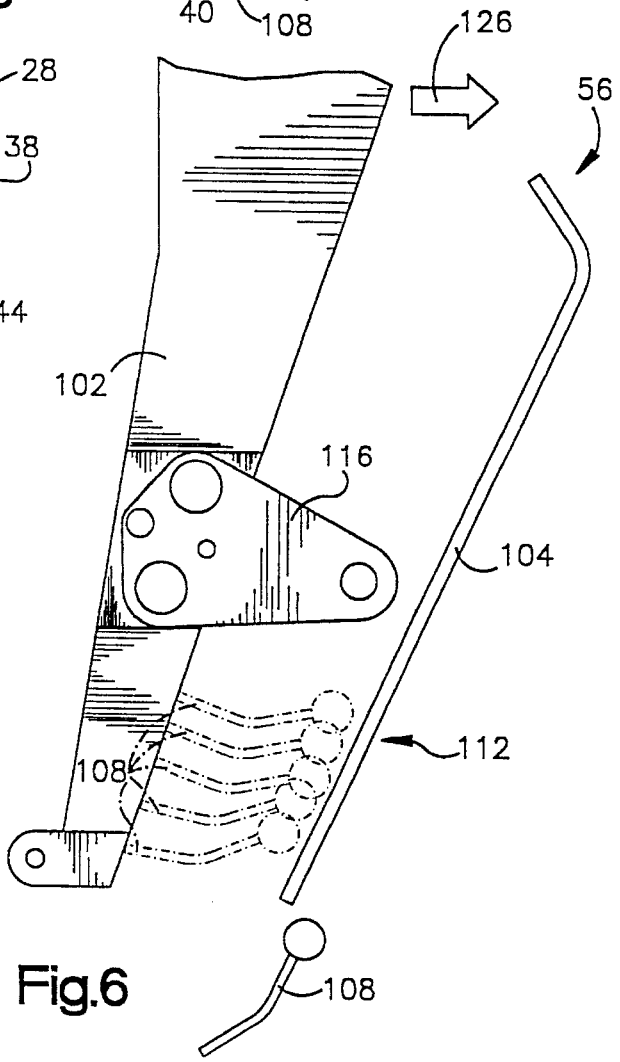
FIG. 6 is a schematic illustration depicting the manner in which the sheet material support is movable between a plurality of closed positions and an open condition.

In accordance with one another of the features of the present invention, a linkage assembly 112 (FIG. 7) retains the sheet material support 108 at each of a plurality of closed positions illustrated in dashed lines in FIG. 6. The linkage assembly 112 also enables the sheet material support 108 to move from any one of the closed positions to the open condition shown in FIG. 8. The linkage assembly 112 maintains the sheet material support 108 in substantially the same orientation relative to the sidewalls 102 and 104 of the pocket 56 when the sheet material support 108 is in any one of the closed positions.

Figure 7:
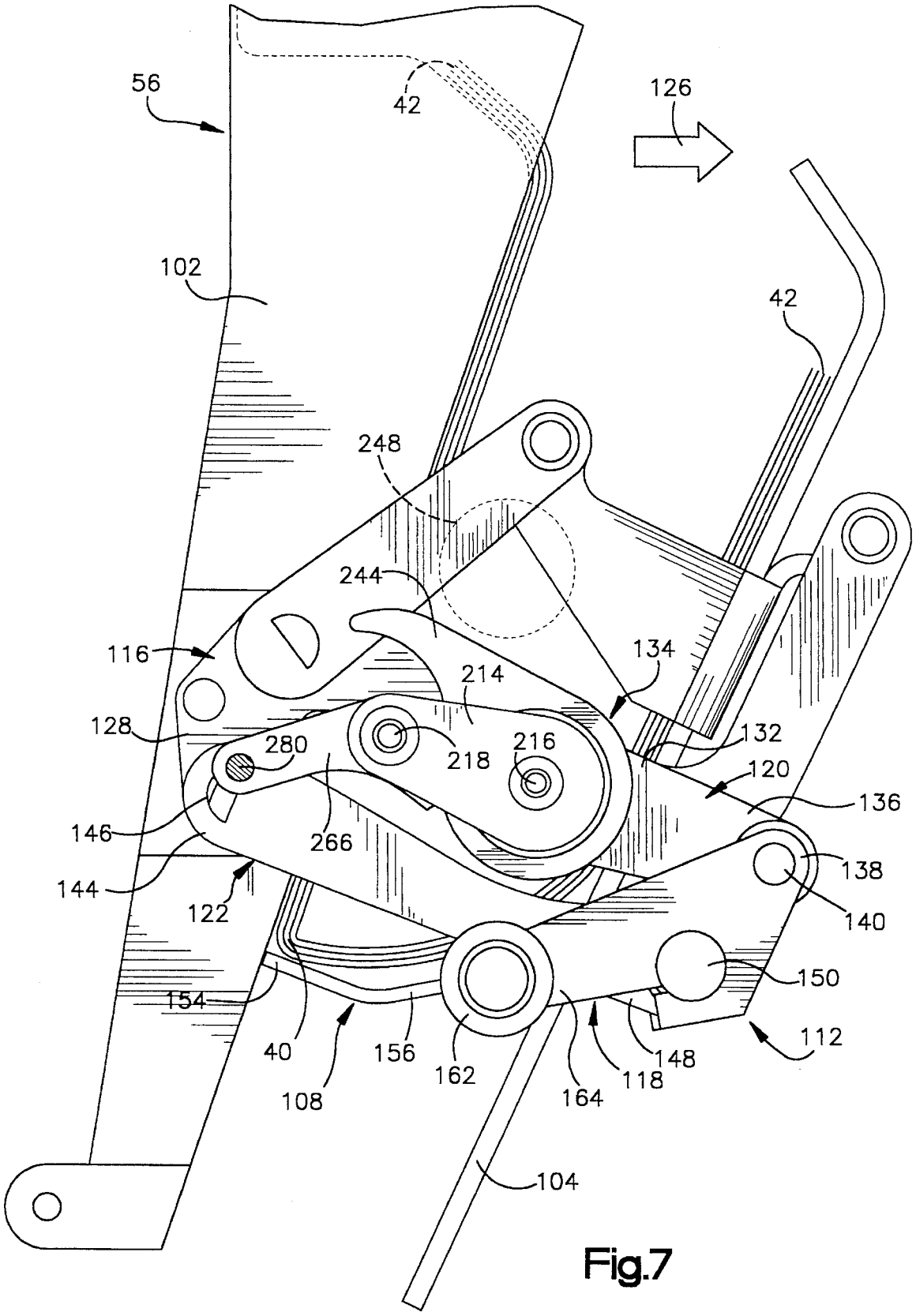
FIG. 7 is a side elevational view of a pocket constructed in accordance with the present invention, a sheet material support in the pocket being shown in the uppermost closed position.
Figure 8:
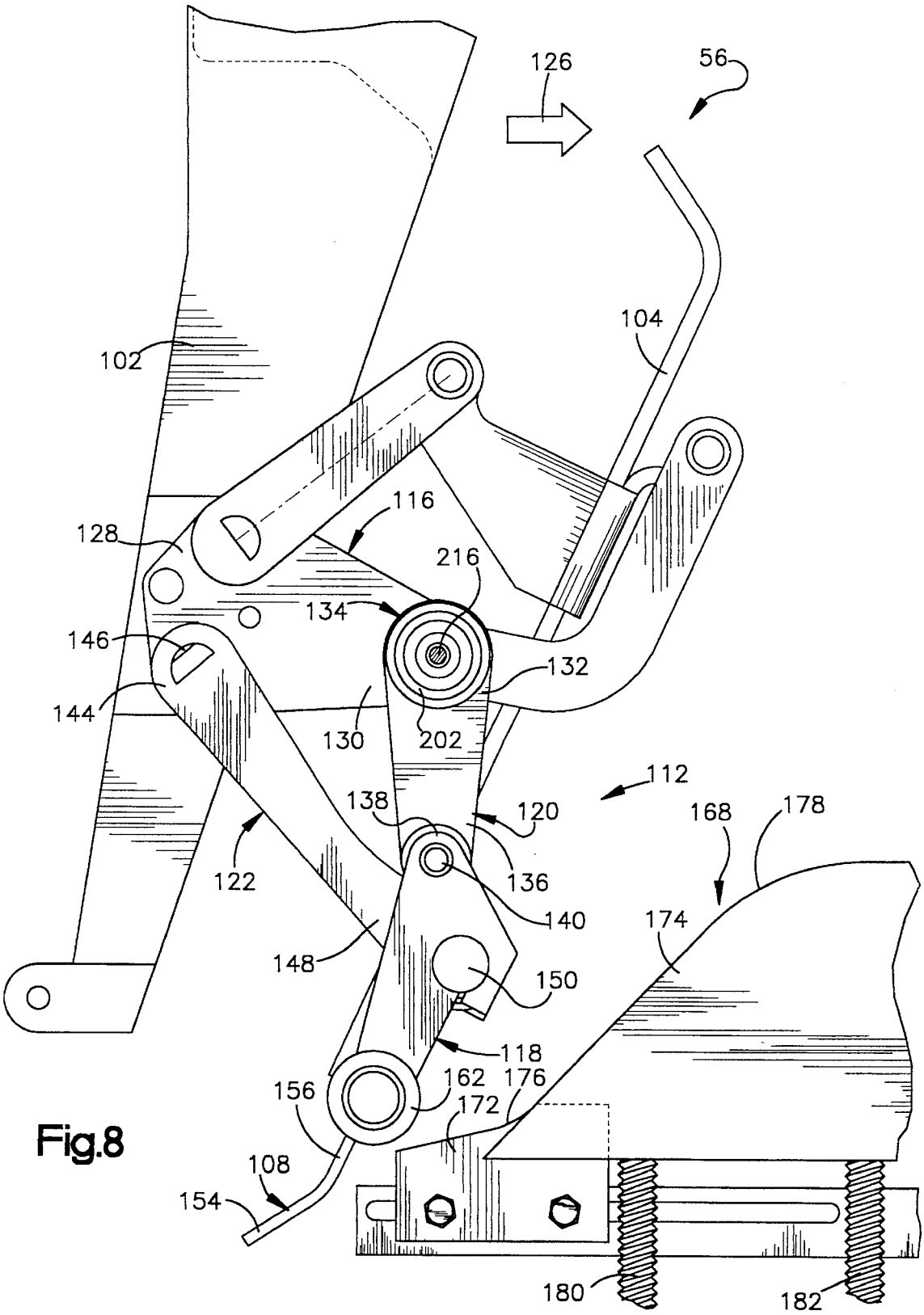
FIG. 8 is a simplified side elevational view of the pocket of FIG. 7, the pocket being shown with a sheet material support in an open condition.

The linkage assembly 112 includes a base link 116 (FIGS. 7 and 8). The base link 116 is fixedly secured to the fixed sidewall 102 of the pocket 56. A support link 118 is fixedly secured to the sheet material support 108. The support link 118 is movably connected with the base link 116 by a first connector link 120 and a second connector link 122.

During operation of the sheet material handling apparatus 20 (FIG. 1), a pocket 56 moves in the direction indicated by the arrows 126 in FIG. 7. A trailing end portion 128 of the base link 116 is secured to the fixed sidewall 102 of the pocket 56. A leading end portion 130 (FIG. 8) of the base link 116 is pivotally connected with an end portion 132 of the first connector link 120 through a clutch assembly 134 (FIG. 7). A portion of the clutch assembly 134 has been removed in FIG. 8 more clearly illustrate the construction of the linkage assembly 112. An outer end portion 136 of the first connector link 120 is connected with an end portion 138 of the support link 118 at a pivot connection 140.

The second connector link 122 (FIGS. 7 and 8) has an inner end portion 144 which is pivotally connected with the trailing end portion 128 of the base link 116 at a pivot connection 146. Rather than being pivotally connected directly with the base link 116 at the pivot connection 146, the end portion 144 of the second connector link 122 could be pivotally connected with the fixed sidewall 102 of the pocket 56. An outer end portion 148 of the second connector link 122 is connected with the support link 118 at a pivot connection 150.

The sheet material support 108 is fixedly connected with and extends outward from the support link 118. The sheet material support 108 includes an outer end portion 154 which extends generally perpendicular to the fixed sidewall 102 of the pocket 56 when the sheet material support 108 is in the closed position shown in FIG. 7. The folded lower edge portion 40 of the jacket 38 engages the sheet material support 108 to support the jacket in the pocket 56.

The sheet material support 108 may be formed by a plate member which extends across the pocket 56. However, in the illustrated embodiment of the invention, the sheet material support 108 is formed by a series of separate plates which are fixedly secured to a connector or cross arm which extends from the pivot connection 150 across the leading side of the movable pocket wall 104. The sheet material support 108 blocks the lower end portion of the pocket 56 to maintain the jacket 38 in the pocket when the sheet material support is in the closed position.

The sheet material support 108 also includes a portion 156 (FIGS. 7 and 8) which is skewed relative to the end portion 154 of the sheet material support. The portion 156 of the sheet material support 108 is fixedly connected with the support link 118. Therefore, the orientation of the sheet material support 108 relative to the support link 118 remains constant during movement of the sheet material support between any one of the closed positions shown in dashed lines in FIG. 6 and the open condition shown in solid lines in FIG. 6.

When the sheet material support 108 is in any one of the closed positions shown in dashed lines in FIG. 6, the linkage assembly 112 is effective to maintain the outer end portion 154 of the sheet material support in substantially the same orientation relative to the fixed sidewall 102 of the pocket 56. This enables the sheet material support 108 to be used to support jackets 38 of different heights in the same orientation relative to the pocket 56.

In the illustrated embodiment of the invention, the linkage assembly 112 (FIGS. 7 and 8) is a four bar linkage which includes the fixed link 116, the support link 118 and the two connector links 120 and 122. This four bar linkage is effective to maintain the sheet material support 108 in substantially the same orientation relative to the fixed sidewall 102 when the sheet material support is in any one of the plurality of closed positions relative to the fixed sidewall. However, it is contemplated that the linkage assembly 112 could have a construction that is different than the four bar construction illustrated in FIGS. 7 and 8.

An actuator roller 162 is rotatably connected with an outer end portion 164 of the support link 118. The actuator roller 162 is engageable with an actuator assembly 168 (FIG. 8) during movement of the pocket 56 in the direction indicated by the arrows 126. The actuator assembly 168 cooperates with the roller 162 and linkage assembly 112 to move the sheet material support 108 from the open condition shown in FIG. 8 to a selected closed position, such as the closed position shown in FIG. 7.

Figure 9:
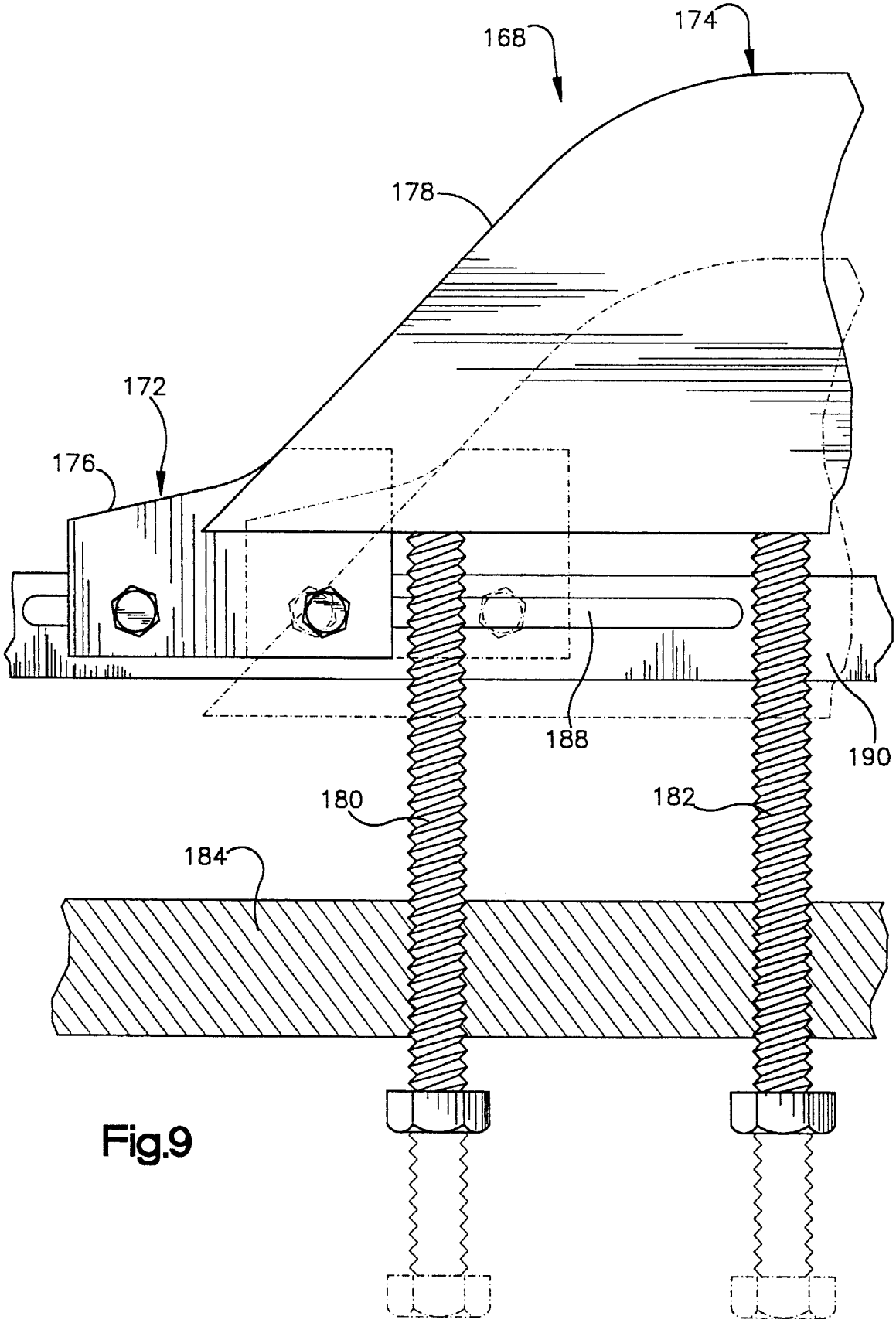
FIG. 9 is a schematic illustration of an actuator for effecting operation of the pocket from the open condition of FIG. 8 to a selected one of the plurality of closed positions.

The actuator assembly 168 could have many different constructions. However, the illustrated actuator assembly 168 includes a lead-in actuation section 172 (FIGS. 8 and 9) and a main section 174. The lead-in section 172 has a cam surface 176 (FIG. 9) which is engaged by the actuator roller 162 to initiate movement of the actuator roller from the open position of FIG. 8 toward the closed position. Continued forward movement of the pocket 56 in the direction indicated by the arrow 126 in FIG. 8, moves the actuator roller 162 into engagement with a cam surface 178 (FIG. 9) on the main section 174 of the actuator assembly 168. As the actuator roller 162 moves along the cam surface 178, the linkage 112 is actuated to move the sheet material support 108 to a closed position, such as the closed position illustrated in FIG. 7.

The main section 174 of the actuator assembly 168 is movable toward and away from the path of movement of the pocket 56 to change the closed position to which the sheet support member 108 is moved. When the actuator screws 180 and 182 are in the extended positions shown in solid lines in FIG. 9, the main section 174 of the actuator assembly 168 extends upward toward the path of movement of the pocket 56. This enables the cam surface 178 to move the actuator roller 162 upward so that the sheet material support 108 is positioned relatively close to the open upper end portion of the pocket 56.

The actuator screws 180 and 182 are rotatable relative to a base member 184 to change the position of the main section 174 of the actuator assembly 168. By rotating the actuator screws 180 and 182 to lower the main section 174 of the actuator assembly 168 from the position shown in solid lines in FIG. 9, the distance which the actuator roller 162 is raised from the open condition of FIG. 8 is reduced. This results in the linkage 112 moving the sheet material support 108 to a closed position which is spaced further from the open upper end portion of the pocket 56. When the actuator screws 180 and 182 are in the retracted positions shown in dashed lines in FIG. 9, the main section 174 is effective to raise the actuator roller 162 upward to move the sheet material support member 108 to the lowermost position of FIG. 5.

When the main section 174 of the actuator assembly 168 is lowered, the lead-in section 172 is moved toward the right (as viewed in FIG. 9) along a slot 188 in a support member 190. The lead-in section 172 of the actuator assembly 178 is moved to a position in which the cam surface 176 on the lead-in section is tangent to the cam surface 178 on the main section 174 of the actuator assembly. This enables the actuator roller 162 to smoothly move from the open condition to the selected one of the closed positions.

Clutch Assembly

The clutch assembly 134 (FIG. 7) is operable between an engaged condition and a disengaged condition. When the clutch assembly 134 is in the engaged condition it transmits force to retain the sheet material support 108 in a selected one of the closed positions. When the clutch assembly is in the disengaged condition, the linkage 112 and the sheet material support 108 move from any one of the closed positions to the open condition illustrated in FIG. 8.

The clutch assembly 134 is subsequently re-engaged with the sheet material support 108 in the open condition of FIG. 8. The actuator assembly 168 (FIG. 9) then effects operation of the linkage 112 (FIGS. 7 and 8) to raise the actuator roller 162 and the sheet material support 108. The actuator assembly 168 raises the sheet material support 108 through each of the closed positions (FIG. 6) in turn. The engaged clutch assembly 134 is effective to transmit force to retain the sheet material support 108 against downward movement from any one of the closed positions.

The clutch assembly 134 includes a helical coil spring 200 (FIG. 10) which interconnects a cylindrical inner hub 202 and a cylindrical outer hub 204 when the clutch assembly 134 is in the engaged condition. The inner hub 202 is fixedly connected with the inner end portion 132 of the first connector link 120 and is pivotally connected with the leading end portion 130 of the base link 116. The inner hub 202 has a cylindrical outer side surface 208. The cylindrical outer side surface 208 of the inner hub 202 is telescopically received in the coil spring 200. The coil spring 200 has a plurality of convolutions 210 with inner side surface areas which engage the cylindrical outer side surface 208 of the inner hub 202 when the clutch assembly 204 is in the engaged condition.

The outer hub 204 (FIG. 10) is fixedly connected to a mounting arm 214. The mounting arm 214 is supported on a pair of pins 216 and 218. The pins 216 and 218 are secured to the base link 116 and hold the mounting arm 214 against movement relative to the base link.

The pin 216 is disposed in a coaxial relationship with the inner hub 202, outer hub 204, and coil spring 210. The pin 216 extends through the inner hub 202, outer hub 204, and the first connector link 120 into engagement with the base link 116. The first connector link 120 and inner hub 202 are rotatable about the central axis of the pin 216.

The pin 218 extends through an opening 222 in the mounting arm 214 and through a cylindrical spacer 224 into engagement with the base link 116. The two pins 216 and 218 cooperate with the base link 116 to hold the mounting arm 214 against rotation relative to the base link. However, the first connector link 120 is pivotal relative to the base link 116 when the clutch assembly 13 is disengaged.

A tang or projection 228 is formed on the coil spring 200 by bending the axially outermost turn of the coil spring 200 radially inwardly. The tang 228 is received in a slot 230 formed in the outer hub 204. The outer hub 204 is telescopically received in the coil spring 200 with the tang 228 disposed in the slot 230.

The tang or projection 228 cooperates with the outer hub 204 to prevent rotation of the coil spring 200 relative to the hub. The outer hub 204 and the mounting arm 214 are held against rotation relative to the base link 116 by the pins 216 and 218. Therefore, the axially outer end portion of the coil spring 200 is held against rotation relative to the base link 116.

A second tang or projection 234 (FIG. 10) extends radially outward from the axially inner end portion of the coil spring 200. The tang 234 engages a recess 236 formed in a cylindrical actuator collar or sleeve 238. The actuator collar 238 has a cylindrical inner side surface 240 which circumscribes the coil spring 200.

When the clutch assembly 134 is in an assembled condition, the inner and outer hubs 202 and 204 are telescopically disposed within the coil spring 200 in a coaxial relationship with the coil spring. The actuator collar 238 extends around the outside of the coil spring 200 and is disposed in a coaxial relationship with the coil spring and the inner and outer hubs 202 and 204. An actuator arm 244 is fixedly connected to the actuator collar 238. The actuator arm 244 is pivotal, in a counterclockwise direction as viewed in FIG. 10, to actuate the clutch assembly 134 from the engaged condition to the disengaged condition.

When the clutch assembly 234 is in the engaged condition, the inner side surfaces of the turns 210 of the coil spring 200 firmly grip the cylindrical outer side surface 208 of the inner hub 202. Therefore, the coil spring 200 holds the inner hub 202 and connector link 120 against rotation relative to the coil spring. Since the tang 228 at the axially outer end of the coil spring 200 engages the slot 230 in the outer hub 204 which is fixedly connected with the outer arm 214 and the base link 116, the first connector link 120 is held against rotation when the clutch assembly 134 is in the engaged condition.

By holding the first connector link 120 against rotation when the clutch assembly 134 is in the engaged condition, the entire linkage 112 (FIG. 7) is held against rotational movement when the clutch assembly is in the engaged condition. Although the clutch assembly 134 interconnects the links 116 and 120 to retain the linkage 112 in the condition shown in FIG. 7 when the clutch assembly is engaged, the clutch assembly could be interconnected with other links in the linkage if desired. For example, the clutch assembly could be interconnected with the links 120 and 118 if desired.

As the pocket 56 is moved in the direction of the arrow 126 in FIG. 7, the actuator arm 244 is engaged by an actuator roller 248 (shown in dashed lines in FIG. 7). The actuator roller 248 is located at the discharge station 94 (FIG. 1) in the path of movement of the actuator arm 244. The actuator roller 248 pivots the actuator arm 244 in a counterclockwise direction as viewed in FIGS. 7 and 10.

Figure 10:
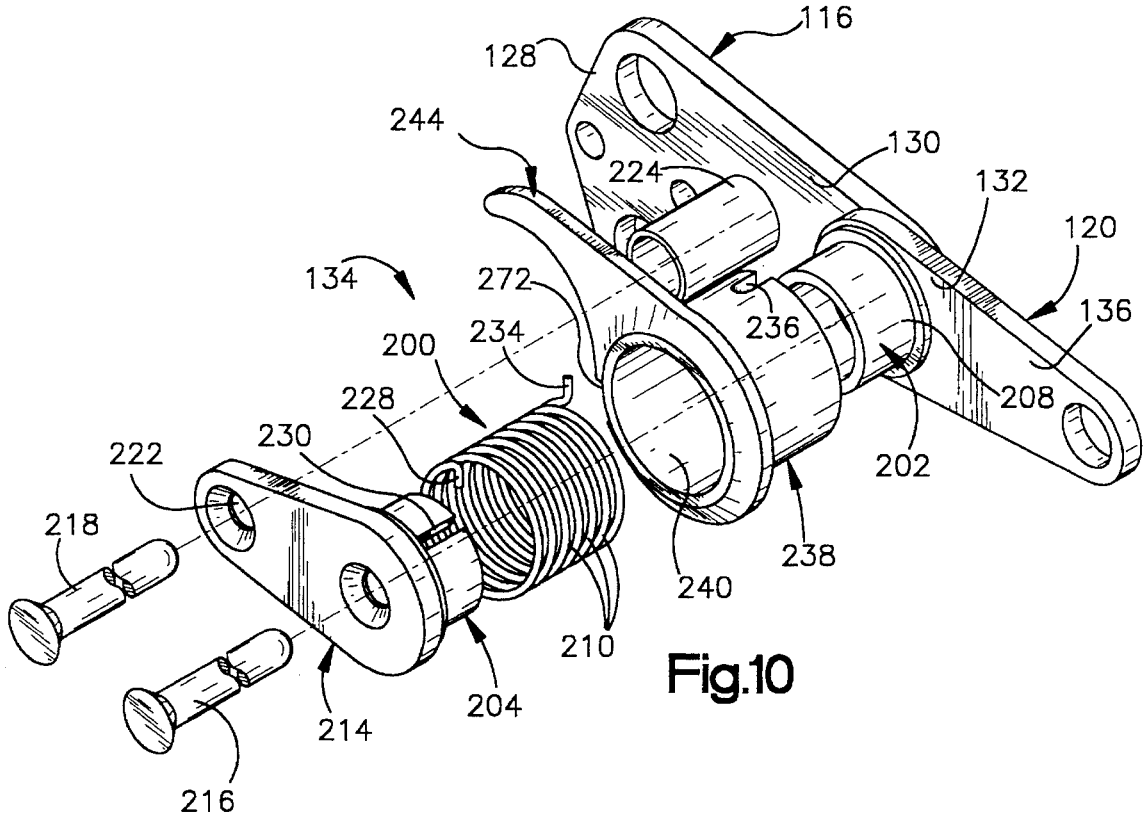
FIG. 10 is an exploded simplified schematic illustration of a clutch used in association with the pocket of FIGS. 7 and 8.

Pivotal movement of the actuator arm 244 and collar 238, in a counterclockwise direction as viewed in FIG. 10, resiliently flexes the coil spring 200 to increase the diameter of the turns 210 of the coil spring. Thus, the collar 238 applies force against the tang 234 at the axially inner end of the coil spring 200 to flex the turns 210 of the coil spring. This flexing of the turns 210 of the coil spring 200 increases the inside diameter of the turns of the coil spring which engage the cylindrical outer side surface 208 of the inner hub 202. This effects operation of the clutch assembly 134 to the disengaged condition and releases the inner hub 202 and first connector link 120 for pivotal movement relative to the base link 116 about the central axis of the inner hub 202 and pin 216.

Upon flexing of the coil spring 200 and operation of the clutch assembly 134 to the disengaged condition by counterclockwise (as viewed in FIG. 10) rotation of the actuator arm 244, the linkage assembly 112 is released to enable the sheet material support 108 to move from any one of the closed positions showed in dashed lines in FIG. 6 to the open condition showed in solid lines in FIG. 6. The sheet material support 108 can move from a closed position to the open condition under the influence of the weight of the sheet material support and the linkage 112. If desired, one or more biasing springs may be connected with the components of the linkage 112 to urge the linkage toward the open condition.

A second actuator roller 252 (FIG. 11) is provided at the discharge station 98 where incorrectly formed sheet material assemblages are released for downward movement onto the repair conveyor 34 (FIG. 1). Since most of the sheet material assemblages 28 will be properly formed, the actuator roller 252 is normally maintained in the raised position, shown in dashed lines in FIG. 11, by a control solenoid 256. When a misfeed is detected at one of the feeders, the control solenoid 256 is actuated to move the actuator roller 252 to the lowered position as shown in solid lines in FIG. 11.

Figure 11:
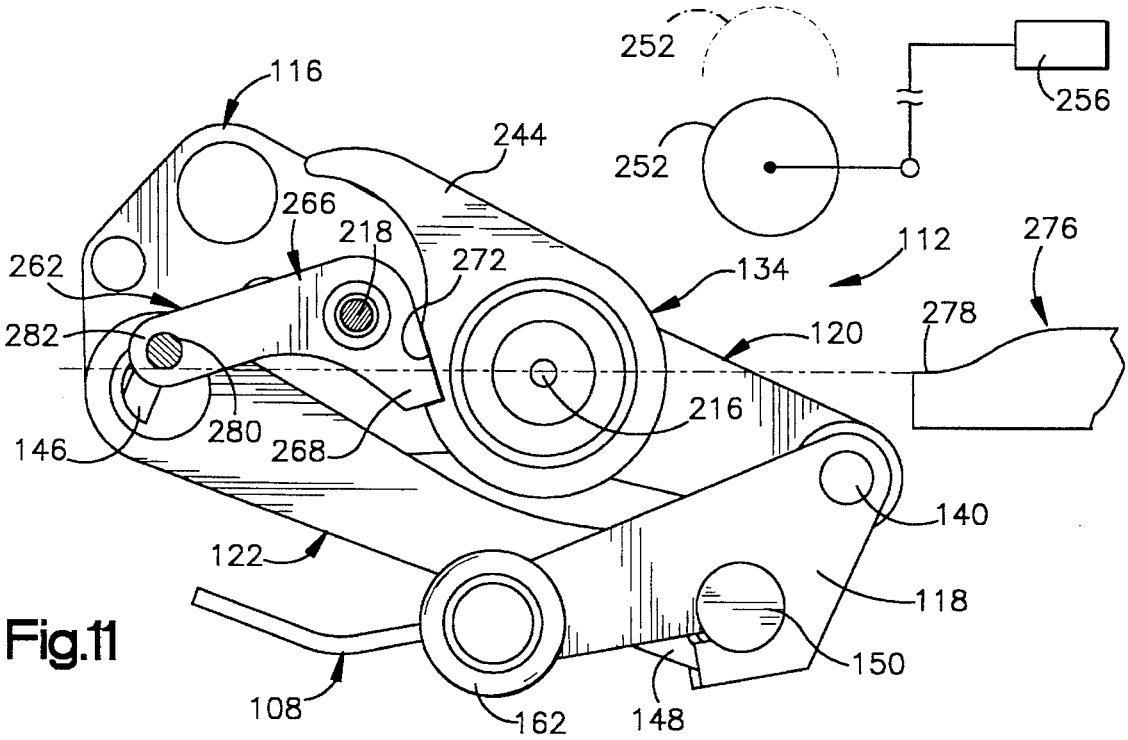
FIG. 11 is a simplified schematic illustration depicting the clutch of FIG. 10 in association with a linkage which connects the sheet material support with the pocket.

When the actuator roller 252 is in the lowered position, shown in solid lines in FIG. 11, the actuator roller is engaged by the clutch actuator arm 244 during movement of the pocket 56 through the discharge station 98 (FIG. 1). Engagement of the actuator arm 244 with the roller 252 operates the clutch assembly 134 to the disengaged condition. Operation of the clutch assembly 134 to the disengaged condition releases the sheet material support 108 for movement from a closed position to the open condition shown in FIG. 8.

The clutch assembly 134 must be maintained in the disengaged condition for a length of time sufficient to enable the sheet material support 108 move from the uppermost closed position (FIG. 7) to the open condition (FIG. 8). To retain the clutch assembly 134 in the disengaged condition, a detent assembly 262 (FIG. 11) is engageable with the actuator arm 244. The detent assembly 262 includes a detent lever 266 which is pivotally supported on the pin 218.

Upon counterclockwise rotation of the actuator arm 244 by either the actuator roller 248 (FIG. 7) or the actuator roller 252 (FIG. 11), a nose-end portion 268 of the detent lever 266 engages a notch 272 in the actuator arm 244. Engagement of the nose-end portion 268 of the detent lever 266 with the notch 272 holds the actuator arm 244 against clockwise rotation under the influence of force applied against the actuator collar 238 (FIG. 10) by the resiliently deflected coil spring 200. Therefore, the clutch assembly 134 is maintained in the disengaged condition as long as the detent lever 266 engages the notch 272 in the actuator arm 244.

Immediately downstream from the main discharge station 94 at which sheet material assemblages are deposited onto the delivery conveyor 32, there is a detent actuator cam 276 (FIG. 11). The detent actuator cam 276 pivots the detent lever 266 to move the nose end portion of the detent lever out of the notch 272. The detent actuator cam 276 has a cam surface 278 which engages a pin 280 which extends outward from an end portion 282 of the detent lever 266 opposite from the nose-end portion 268.

Engagement of the pin 280 with the cam surface 278 pivots the detent lever 266 in a clockwise direction about the pin 218. As this occurs, the nose-end portion 268 of the detent lever 266 is disengaged from the notch 272 in the actuator arm 244. Upon disengagement of the nose-end portion 268 of the detent lever 266 from the notch 272 in the actuator arm 244, the coil spring 200 (FIG. 10) causes the actuator collar 238 and actuator arm 244 to pivot in a clockwise direction about the pin 216.

As the actuator arm 244 and actuator collar 238 pivot in a clockwise direction (as viewed in FIGS. 10 and 11) about the pin 216, the coil spring 200 is released. As this occurs, the turns 210 of the coil spring extending around the cylindrical outer side surface 208 of the inner hub 202 decrease in the diameter. The axially inner turns 210 of the coil spring 200 firmly grip the outer side surface 208 of the inner hub 202 to hold the inner hub against clockwise rotation (as viewed in FIG. 8). However, the hub 202 is free to pivot in a counterclockwise direction (as viewed in FIGS. 8 and 10) relative to the turns 210 (FIG. 10) of the coil spring 200.

Subsequent engagement of the actuator roller 162 with the actuator assembly 168 (FIG. 9), pivots the support link 118 (FIG. 8) in a clockwise direction about the pivot connection 150. This pivots the first connector link 120 in a counterclockwise direction about the pin 216 even though the clutch assembly 134 is in the engaged condition. The first connector link 120 can pivot in a counterclockwise direction because rotation of the inner hub 202 (FIG. 10) relative to the coil spring 200 applies forces to the inside of the turns 210 in the coil spring tending to loosen or increase the diameter of the turns of the coil spring. Therefore, when the clutch assembly 134 is in the engaged condition, the inner hub 202 can rotate in a counterclockwise direction (as viewed in FIG. 10) while being prevented from rotating in a clockwise direction by tightening of the turns of the coil spring 200.

In the illustrated collating conveyor assembly 26, the pockets 56 are arranged in a circular array (FIG. 1). The linkage assemblies 112 (FIG. 7) are disposed adjacent to sides of the pockets 56 disposed at a radially outermost portion of the circular array pockets. It should be understood that each of the pockets 56 has a second linkage assembly which corresponds to and is a mirror-image of the linkage assembly 112. The second linkage assembly is disposed adjacent to a radially inner side of the pocket.

The linkage assembly 112 is connected with the linkage assembly adjacent to the radially inner side of the pocket 56 by a cylindrical cross connector or connector shaft which extends from the pivot connection 150 (FIG. 7) across the leading side of the movable sidewall 104 of the pocket 56 to the linkage assembly disposed adjacent to the radially inner side of the pocket. A second cross or connector shaft extends from the pivot connection 146 along a trailing side of the fixed sidewall 102. These cross or connector shafts interconnect the radially inner and outer linkages so that they are operated together. The inner linkage is disposed adjacent to the radially inner side of the pocket 56 and does not include a clutch assembly corresponding to the clutch assembly 134. Therefore, operation of the clutch assembly 134 from the engaged condition to the disengaged condition is effective to release both the linkage assembly 112 adjacent to the radially outer side of the pocket 56 and the linkage assembly adjacent to the radially inner side of the pocket 56.

Operation

During operation of the sheet material handling apparatus 20, sheet material assemblages, that is, newspapers 28, are formed. As the rotor 54 and pockets 56 are moved in a counterclockwise direction (as viewed in FIG. 1) jackets 38 are fed into the pockets 56. As the rotor 54 sequentially moves the pockets 56 beneath the hoppers 68, inner sections 66 are fed by sheet feed mechanisms 70 into the jackets 38 in the pockets 56 until a newspaper 28 containing a desired number of sections has been formed.

Continued rotation of the rotor 54 brings each of the pockets in turn to the discharge station 94 (FIG. 1). When a pocket 56 enters the discharge station 94, the sheet material support 108 is in one of the closed positions illustrated in dashed lines in FIG. 6. As the pocket moves through the initial portion of the discharge station 94, the actuator arm 244 (FIG. 7) engages the actuator roller 248.

The actuator roller 248 causes the actuator arm 244 to pivot in a counterclockwise direction (as viewed in FIGS. 7 and 10) about the pin 216. As this occurs, the collar 238 (FIG. 10) flexes the turns of the coil spring 200 to disengage the clutch 134 by loosening the grip of the coil spring on the inner hub 202. As the clutch 134 is disengaged, the first connector link 120 and sheet material support 108 are released for downward movement from the closed position shown in FIG. 7 to the open condition shown in FIG. 8. As the actuator arm 244 is pivoted in a counterclockwise direction about the support pin 216, the nose-portion 268 of the detent lever 266 moves into engagement with the notch 272 (FIG. 11) in the actuator arm 244 to retain the clutch assembly 134 in the disengaged condition.

As the sheet material support 108 moves to the open condition illustrated in FIG. 8, the newspaper drops downward from the pocket 56 and is engaged by the delivery conveyor 32 in the manner described in U.S. Pat. No. 4,721,296. As the forward movement of the pocket 56 continues, the pin 280 (FIG. 11) on the detent lever 266 engages the cam surface 278. The cam surface 278 raises the pin 280 and pivots the detent lever 266 in a clockwise direction to release the actuator arm 244. Releasing the actuator arm 244 enables the clutch 134 to return to its engaged condition.

As the pocket 56 leaves the discharge station 94, the actuator roller 162 (FIG. 8) on the lower end portion of the support link 116 moves into engagement with the actuator assembly 168. As this occurs, the cam surface 176 (FIG. 9) on the lead-in section 172 of the actuator assembly 168 is engaged by the actuator roller 162. This initiates pivotal movement of the support link 118 in a clockwise direction about the pivot connection 150. Continued forward movement of the pocket 56 moves the actuator roller 162 into engagement with the main section 174 of the actuator assembly 168. The main section 174 of the actuator assembly 168 continues the clockwise pivotal movement of the support link 118 to move the actuator roller 162 and sheet material support 108 upward to its closed position.

The closed position of the sheet material support 108 may be anywhere in the range of closed positions indicated in dashed lines in FIG. 6. The position at which the main section 174 (FIG. 9) of the actuator assembly 168 is located by the actuator screws 180 and 182 determines the distance which the sheet material support is moved upward. Therefore, the position of the main section 174 of the actuator assembly 168 determines the closed position to which the sheet material support 108 is moved.

When a relatively short newspaper jacket 38*a* (FIG. 4) is to be formed in the pocket 56, the distance from the folded edge portion 40 to the open edge portions 42 is relatively small. Therefore, the sheet material support 108 is moved to the uppermost closed position of FIG. 4. When the distance between the folded edge portion 40 and open edge portions 42 of the newspaper 28 is relatively large, the tall newspaper jacket 38*b* (FIG. 5) is supported in the pocket 56 with the sheet material support 108 at the lowermost closed position.

The actuator assembly 168 is adjusted so that the closed position of the sheet material support 108 corresponds to the height of the newspaper jacket 38. Therefore, the open edge portions 42 of the newspaper jacket are always in the same position relative to the sidewalls 102 and 104. This enables gripper assemblies (not shown) and/or other devices to be used to perform operations on the open edge portions 42 a newspaper having a relatively small height or a newspaper having a relatively large height.

It is contemplated that on rare occasions, a misfeed may occur during use of the sheet material handling apparatus 20. When this happens, the control solenoid 256 is actuated to move the actuator roller 252 at the discharge station 98 into the path of movement of the actuator arm 244. This results in the pocket 56 containing the defective newspaper being actuated to an open condition at the discharge station 98. Once the pocket 56 has been opened, the defective newspaper falls downwardly onto the repair conveyor 34. The actuator roller 252 is then retracted so that succeeding pockets 56 can move through the discharge station 98 without being opened.

Although the foregoing description has related to a circular collator conveyor assembly 26, it is contemplated that the collator conveyor assembly could have a different configuration if desired. For example, the collator conveyor assembly could have an oval configuration with parallel linear sections interconnected by arcuate end sections. As a further example, the collator conveyor assembly could have a linear configuration with vertically offset sections.

Although the foregoing description has related to the formation of sheet material assemblages which are newspapers, it is contemplated that the present invention could be used in the formation of sheet material assemblages which are not newspapers. For example, the invention could be used in connection with the formation of sheet material assemblages which are booklets or magazines.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for use in forming sheet material assemblages, said apparatus comprising a plurality of sheet material feeders, and a plurality of pockets movable past each of said sheet material feeders in turn to enable said sheet material feeders to sequentially feed sheet material into said pockets, each one of said pockets having side portions which at least partially define an upper end portion through which sheet material enters said one pocket, a lower end portion through which sheet material leaves said one pocket, and a sheet material support which supports sheet material in said one pocket, said sheet material support being movable relative to said side portions of said one pocket between a plurality of closed positions in which said sheet material support is spaced different distances from said upper end portion of said one pocket and at least partially blocks said lower end portion of said one pocket, said sheet material support being movable from each of said closed positions to an open condition in which said sheet material support is at least partially offset from said lower end portion of said one pocket to enable sheet material to move out of said one pocket through said lower end portion of said one pocket.

2. An apparatus as set forth in claim 1 wherein said one pocket includes a clutch which is operable between an engaged condition and a disengaged condition, said clutch being effective to transmit force to retain said sheet material support in one of said closed positions when said clutch is in the engaged position, said clutch being ineffective to transmit force to retain said sheet material support in said one of said closed positions when said clutch is in the disengaged condition.

3. An apparatus as set forth in claim 1 wherein said one pocket includes a linkage interconnecting said sheet material support and said side portions of said one pocket, said apparatus further including a member which actuates said linkage to move said sheet material support from the open condition to one of said closed positions as said one pocket is moved relative to said sheet material feeders.

4. An apparatus as set forth in claim 1 wherein said sheet material support is pivotal about an axis which is offset from a space between said side portions of said one pocket to enable said sheet material support to move between said closed positions and said open condition.

5. An apparatus as set forth in claim 1 wherein said one pocket includes means for maintaining the orientation of said sheet material support constant relative to said side portions of said one pocket during movement of said sheet material support between said closed positions.

6. An apparatus as set forth in claim 1 wherein said one pocket includes a first link fixedly connected with one of said side portions of said one pocket, a second link pivotably connected with said first link, a third link pivotably connected with said second link, and a fourth link pivotally connected with said third link and with said one of said side portions of said one pocket and with said first link, said sheet material support being connected with said third link for movement therewith relative to said side portions of said one pocket.

7. An apparatus as set forth in claim 6 further including a clutch interconnecting said first and second links, said clutch being operable between an engaged condition retaining said second, third and fourth links against pivotal movement and a disengaged condition in which said clutch is ineffective to retain said second, third and fourth links against pivotal movement.

8. An apparatus as set forth in claim 1 wherein said one pocket further includes a first surface area which is connected with one of said side portions, a second surface area which is connected with said sheet material support, and a coil spring having a plurality of turns, said turns of said coil spring including inner side surface means for gripping said first and second surface areas to prevent movement of said sheet material support from one of said closed positions to said open condition, said inner side surface means on said coil spring and one of said first and second surface areas being relatively rotatable to enable said sheet material support to move from said one of said closed positions to said open condition.

9. An apparatus as set forth in claim 8 wherein said sheet material support is pivotal about an axis extending parallel to a central axis of said coil spring to enable said sheet material support to move from said one of said closed positions to said open condition during relative rotation between said inner side surface means on said coil spring and said one of said first and second surface areas.

10. An apparatus as set forth in claim 1 wherein said one pocket further includes a clutch interconnecting one of said side portions of said one pocket and said sheet material support, said clutch being operable between an engaged condition in which said clutch retains said sheet material support against movement from one of said closed positions to said open condition and a disengaged condition in which said clutch is ineffective to retain said sheet material support against movement from said one of said closed positions to said open condition, said clutch including a first surface area connected with one of said side portions of said one pocket, a second surface area connected with said sheet material support, and a coil spring having a plurality of turns which grip said first and second surface areas when said clutch is in the engaged condition, said plurality of turns of said coil spring being ineffective to grip one of said first and second surface areas when said clutch is in the disengaged condition.

11. An apparatus as set forth in claim 10 wherein said first and second surface areas have a cylindrical configuration and are coaxial with a central axis of said coil spring, said sheet material support being pivotal between said one of said closed positions and the open condition about an axis which extends parallel to a central axis of said coil spring when said clutch is in the disengaged condition.

12. An apparatus as set forth in claim 10 wherein said one pocket further includes an actuator member which is connected with said coil spring and is rotatable about a central axis of said coil spring to flex said turns of said coil spring in a direction tending to increase the size of the turns of said coil spring to effect operation of said clutch from the engaged condition to the disengaged condition.

13. An apparatus as set forth in claim 10 wherein said one pocket further includes a first link fixedly connected with one of said side portions of said first pocket and with said first surface area, a second link pivotally connected with said first link, said second surface area being fixedly connected with said second link for pivotal movement therewith relative to said first link, a third link pivotally connected with said second link, and a fourth link pivotally connected with said third link and with said one of said side portions and said first link, said sheet material support being connected with said third link for movement therewith relative to said side portions of said one pocket.

14. An apparatus for use in forming sheet material assemblages, said apparatus comprising:

a plurality of sheet material feeders;

a plurality of pockets movable along a circuitous path past each of said plurality of sheet material feeders in turn, each of said pockets of said plurality of pockets including a sheet material support which is movable between a plurality of closed positions spaced different distances from an open upper end portion of said pocket and at least partially blocking a lower end portion of said pocket and an open condition offset from a lower end portion of said pocket, said sheet material support being ineffective to block said lower end portion of said pocket when said sheet material support is in the open condition; and an actuator surface movable between a plurality of positions relative to the circuitous path of movement of said pockets, said actuator surface being engageable with a portion of each of said pockets in turn to move said sheet material support in each of said pockets in turn from the open condition to any one of the closed positions depending upon the position of said actuator member relative to the circuitous path of movement of said pockets.

15. An apparatus as set forth in claim 14 further wherein each of said pockets includes a clutch which is operable between an engaged condition and a disengaged position, said clutch being effective to retain said sheet material support in a closed position to which the sheet material support is moved by said actuator surface when said clutch is in the engaged condition, said clutch being ineffective to retain said sheet material support in a closed position when said clutch is in the disengaged condition.

16. An apparatus as set forth in claim 14 further including adjustment apparatus connected with said actuator surface, said adjustment apparatus being operable to move said actuator surface between first and second positions relative to the circuitous path of movement of said pockets, said adjustment surface being engageable with each of said pockets in turn to move said sheet material support in each of said pockets in turn to a first closed position in which said sheet material support is spaced a first distance from an open upper end portion of one of said pockets when said adjustment surface is in the first position, said adjustment surface being engageable with each of said pockets in turn to move said sheet material support in each of said pockets in turn to a second closed position in which said sheet material support is spaced a second distance from an open upper end portion of one of said pockets when said adjustment surface is in the second position, said first distance being greater than said second distance.

17. A method of forming sheet material assemblages of different sizes, said method comprising the steps of moving a pocket along a circuitous path with a sheet material support in the pocket in a first closed position in which the sheet material support is spaced a first distance from an open upper end of the pocket and in which the sheet material support at least partially blocks a lower end of the pocket, feeding first sheet material of a first size into the pocket through the open upper end of the pocket while the pocket is moving along the circuitous path with the sheet material support in the first closed position to form a first sheet material assemblage, moving the sheet material support from the first closed position to an open condition in which the sheet material support is ineffective to block the lower end of the pocket while the pocket is moving along the circuitous path, moving the first sheet material assemblage from the pocket through the lower end of the pocket while the sheet material support is in the open condition and while the pocket is moving along the circuitous path, moving the sheet material support from the open condition to a second closed position in which the sheet material support is spaced a second distance from the open upper end of the pocket and in which the sheet material support at least partially blocks the lower end of the pocket while the pocket is moving along the circuitous path, feeding second sheet material of a second size into the pocket through the open upper end of the pocket while the pocket is moving along the circuitous path with the sheet material support in the second closed position to form a second sheet material assemblage of a size which is different than the size of the first sheet material assemblage, moving the sheet material support from the second closed position to the open condition while the pocket is moving along the circuitous path, moving the second sheet material assemblage from the pocket through the lower end of the pocket while the sheet material support is in the open condition and while the pocket is moving along the circuitous path.

* * * * *